US005896756A

United States Patent [19]

Watkins

[11] Patent Number: 5,896,756

[45] Date of Patent: Apr. 27, 1999

[54] SOFT NECKLACE

[76] Inventor: James O. Watkins, 8901 Bradmoor Dr., Bethseda, Md. 20817

[21] Appl. No.: 08/932,766

[22] Filed: Sep. 18, 1997

[51] Int. Cl.[6] ..... A44C 5/00

[52] U.S. Cl. ..... 63/3; 63/38; D11/3; D11/6

[58] Field of Search ..... 28/147; 63/3, 4, 63/33, 37, 38, 39; 132/273, 275; 428/7, 10; D11/3, 6, 8, 11, 119

[56] References Cited

U.S. PATENT DOCUMENTS

| | | | |
|---|---|---|---|
| D. 60,377 | 2/1922 | Sabbath | D11/11 |
| D. 128,494 | 7/1941 | Lerner et al. | D11/11 |
| D. 158,103 | 4/1950 | Kuenstner | D28/41 |
| D. 292,500 | 10/1987 | Ford, Jr. | D11/26 |
| D. 298,700 | 11/1988 | Caraballo | D5/7 |
| D. 356,279 | 3/1995 | Ruff | D11/119 |
| 2,595,657 | 5/1952 | Harmon | 132/273 |
| 3,303,539 | 2/1967 | White | 63/3 X |
| 3,656,244 | 4/1972 | Andrade | 36/1 |
| 5,386,710 | 2/1995 | Moore | 63/3 |
| 5,566,435 | 10/1996 | Brown, Jr. | 28/120 |

*Primary Examiner*—Kenneth J. Dorner
*Assistant Examiner*—Andrea Chop
*Attorney, Agent, or Firm*—Ronald B. Sherer

[57] ABSTRACT

A necklace which is comprised of a plurality of soft Pom-Pom balls such that the necklace may be thrown to participants at celebrations without injury while still being very festive for the occasion.

6 Claims, 1 Drawing Sheet

SOFT NECKLACE

FIELD

This invention relates to the field of necklaces, and more particularly to necklaces worn at parties and festive occasions.

BACKGROUND

It is a long-standing custom at various festive events, and particularly at Mardi Gras, for performers to throw brightly-colored necklaces to the audiences such as from floats in a parade, the stage or from balconies. Such necklaces must be ultra-low cost to produce since they are thrown gratis, and they must be pretty and colorful so as to become lasting and treasured souvenirs of the festive occasion. Prior necklaces have met the low-cost requirement by being composed of a plurality of cheap plastic spheres. However, such plastic spheres are not particularly memorable nor unique, and they are extremely hard and brittle such that injury may result from being struck by, or stepping upon, such plastic necklaces.

SUMMARY

The present invention overcomes this serious injury problem, as well as providing a more decorative and more fun-to-wear necklace, by manufacturing the necklace from a plurality of soft, resilient Pom-Pom balls.

DETAILED DESCRIPTION

Figure 1:
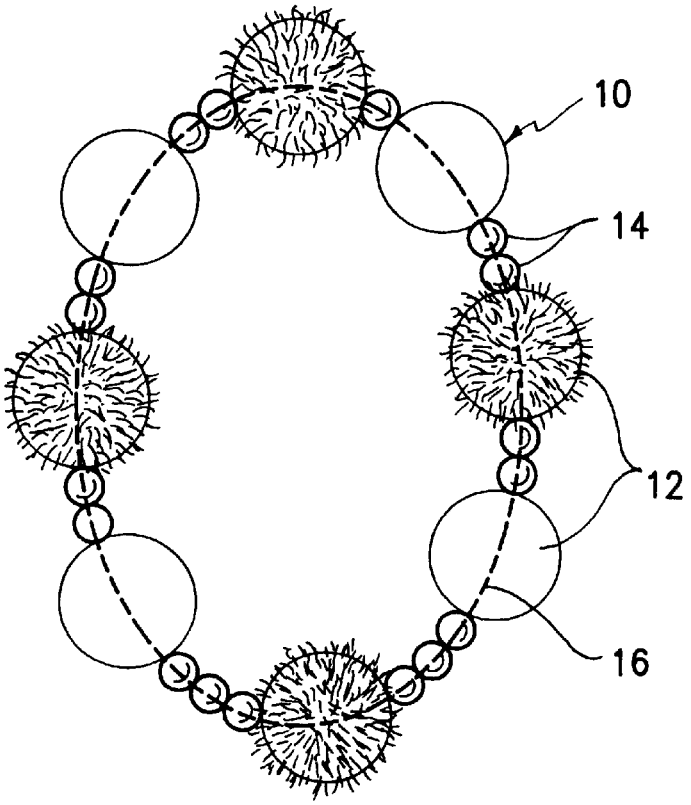
FIG. 1 is a schematic, top plan view of a necklace of the present invention.

Referring first to FIG. 1, a necklace 10 is shown as comprising a plurality of soft Pom-Pom balls 12, each of which is spaced by one or more spacer beads 14, all of which Pom-Pom balls and spacer beads being strung on a flexible string or cord 16. Cord 16 may be a fibrous strand such as a thread, or a flexible strand of any plastic material such as, for example, polypropylene. Beads 14 serve to space the Pom-Pom balls apart, and may be composed of any suitable material such as plastic, glass, wood or other material. Preferably, Pom-Pom balls 12 have a diameter of ½ to 2½ inches, while the diameter of spacer beads 14 is preferably much smaller such as, for example, in the order of ⅛ to ¾ inch. Alternatively, spacer beads 14 may also be composed of soft materials such as cotton balls which may be coated in colors or encased in a colorful fabric.

The structure of the Pom-Pom balls 12 may take various forms so long as they have a soft, resilient and colorful surface. As illustrated schematically in FIG. 2, one preferred structure of the Pom-Pom balls may comprise a large plurality of radially extending lengths of soft fibers or yarn 20 which are banded together by a thread or cord 22 at the center of the ball. The lengths of yarn are preferably multi-colored within each ball, or individual balls may be of the same color and may be joined with balls of other colors in the necklace.

Figure 2:
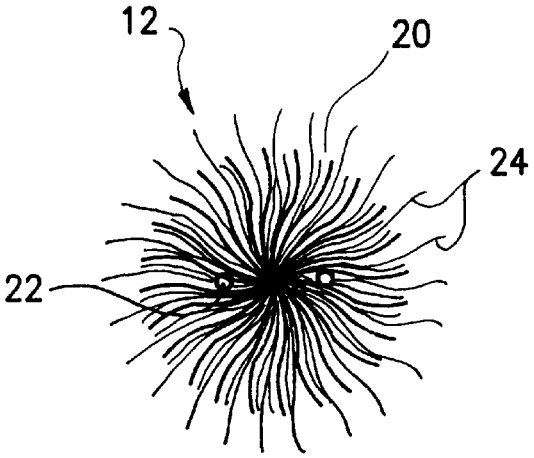
FIG. 2 is a cross-sectional view of one form of Pom-Pom ball which may be used in the necklace of FIG. 1.

As further illustrated in FIG. 2, the preferred embodiment of the present invention includes the provision of soft projections 24 extending radially outwardly of the spherical surface of some or all of the Pom-Pom balls. Projections 24 are composed of a soft fibrous material such as colored threads, or they may be composed of plastic filaments, and the filaments may be coated with a shiny metallic coating of one or more colors per ball. Thus, some or all of the soft balls 12 of the necklace may be covered with tiny, shining and glistening projections 24 which capture and reflect the light when worn. One preferred material for projections 24 comprises metalized strips of plastic film, such as PVC film i.e., polyvinyl chloride. The width or diameter of the projections is preferably in the order of 1/64 of an inch or less to ¼. The distance that projections 24 extend from the spherical surface of the balls may vary depending upon the effect to be created. However, it has been discovered that projections extending in the order of ⅛ to ¾ of an inch, and preferably ¼ to ½ of an inch, from the spherical surface of the ball provide the optimum combination of softness, color, and shining glitter when worn.

Figure 3:
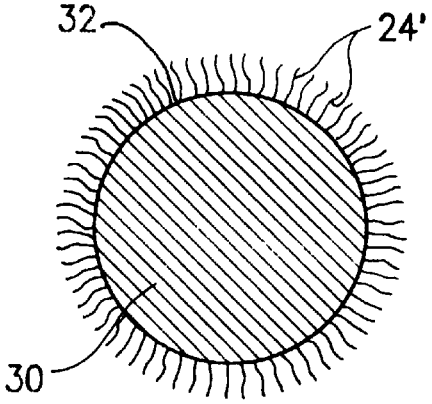
FIG. 3 is a cross-sectional view of another form of Pom-Pom ball which may be used in the necklace of FIG. 1.

As previously stated, Pom-Pom balls may be manufactured in various forms, and FIG. 3 schematically illustrates another form. In this embodiment, a soft core 30 of cotton, polyester foam or other filling material is surrounded by an outer spherical layer 32. Layer 32 may be of any soft material such as cotton cloth or soft plastic cloth such as woven polyester fibers. In this embodiment, projections 24' are retained in place by layer 32 into which they may be woven, glued or otherwise secured instead of extending radially toward the center of the ball as in the FIG. 2 embodiment. Projections 24' should extend radially outwardly to the same distances as previously described, and preferably, projections 24' should be composed of a material which is not only soft and colored, but also has a shiny and glittering effect as previously described.

From the foregoing description, it will be apparent that the necklace of the present invention comprises an extremely colorful and festive adornment which is ultra-low in cost, and which provides a soft, safe and unique necklace which may be thrown without danger of injury, and which will become a long-lasting memento of the celebration. It will also be apparent that the necklaces of the present invention are not limited to Mardi Gras celebrations, and are also ideally suited to be given as party favors at any occasion, and particularly at celebrations of New Year's, birthdays, anniversaries, and any and all festive and memorable events.

Of course, it is to be understood that the foregoing description is intended to be illustrative of the principles of the invention, and is not intended to be exhaustive of the many possible forms of the invention. For example, spacer beads 14 may be of any size or number and may be composed of hard or soft materials since the necklace is cushioned by the larger Pom-Pom balls. Similarly, Pom-Pom balls 12 may be provided in bright, shiny colors without projections 24, 24'. However, the provision of the glittering projections has been discovered to unexpectedly enhance the festive and memorable appearance of the necklace beyond that possible without the projections. It is also to be understood that the foregoing description is intended only to illustrate several preferred embodiments of the invention, and that the invention is not intended to be limited other than as expressly set forth in the following claims as interpreted under the doctrine of equivalents.

What is claimed is:

1. A festive necklace of a size and shape to fit about the neck of a wearer comprising:

(a) a flexible cord;

(b) a plurality of soft, resilient Pom-Pom balls;

(c) each of said Pom-Pom balls having a spherical surface;

(d) said plurality of soft, resilient Pom-Pom balls being arranged along said flexible cord to form a necklace; and (e) each of said Pom-Pom balls having soft, flexible projections extending radially outwardly from said spherical surfaces of said Pom-Pom balls to form a soft necklace which may be thrown without injury.

2. The festive necklace of claim 1 wherein said projections extend radially outward from said spherical surfaces of said Pom-Pom balls by a distance in the order of ⅛ to ¾ inches.

3. The festive necklace of claim 1 wherein said projections are comprised of thin strips of metalized plastic.

4. The festive necklace of claim 3 wherein said projections are composed of thin strips of metalized and colored plastic.

5. The festive necklace of claim 4 wherein said projections are comprised of polyvinyl chloride plastic.

6. The festive necklace of claim 1 wherein said Pom-Pom balls are spaced along said flexible cord by a plurality of spacer beads such that each Pom-Pom ball is spaced and not pressed by an adjacent Pom-Pom ball.

* * * * *